US005409206A

United States Patent [19]

Marzullo et al.

[11] Patent Number: 5,409,206

[45] Date of Patent: Apr. 25, 1995

[54] APPARATUS FOR BUFFERING TRANSPORT OF DOCUMENTS

[75] Inventors: Joseph H. Marzullo, Brookfield; Steven A. Supron, Prospect; Brian S. Thompson, Derby; Ming Xiao, Terryville, all of Conn.

[73] Assignee: Pitney Bowes Inc., Stamford, Conn.

[21] Appl. No.: 174,870

[22] Filed: Dec. 29, 1993

[51] Int. Cl.[6] ..... B65H 29/42

[52] U.S. Cl. ..... 271/179; 271/185; 198/663; 101/424.1; 400/625; 347/102

[58] Field of Search ..... 271/177, 178, 179, 184, 271/185, 225; 414/795.1, 793.9, 794.2; 198/663, 671; 101/424.1; 400/625; 347/102; 34/203

[56] References Cited

U.S. PATENT DOCUMENTS

| | | | |
|---|---|---|---|
| 3,280,679 | 10/1966 | Huffman | 271/179 X |
| 4,270,747 | 6/1981 | Templeton | 271/179 |
| 4,547,114 | 10/1985 | Watrous et al. | 271/179 X |

FOREIGN PATENT DOCUMENTS

| | | | |
|---|---|---|---|
| 541896 | 6/1950 | Canada | 271/179 |
| 740838 | 2/1933 | France | 271/179 |
| 0002503 | 1/1980 | Japan | 414/795.1 |
| 0034851 | 2/1989 | Japan | 271/179 |

*Primary Examiner*—H. Grant Skaggs
*Assistant Examiner*—Carol L. Druzbick
*Attorney, Agent, or Firm*—Robert H. Whisker; Melvin J. Scolnick; Dave E. Pitchenik

[57] ABSTRACT

An apparatus for buffering transport of freshly inked documents is comprised of an upper deck oriented at an acute angle with respect to a horizontal plane. The apparatus has a plurality of opposite, parallel, threaded screw conveyers orthogonal to the upper deck. Inked documents travel upon the threads of the screw conveyers. A lower deck is provided for receiving inked documents. An eject pin mechanism causes the inked documents to be delivered from the apparatus.

10 Claims, 3 Drawing Sheets

APPARATUS FOR BUFFERING TRANSPORT OF DOCUMENTS

BACKGROUND OF THE INVENTION

The present invention relates to a document buffer and more particularly to an apparatus for buffering transport of documents coated with a liquid ink.

For increasing the throughput of mailing machines, it is important to provide means for buffering transport of inked documents exiting a liquid ink printer, such as an ink jet printer, so that the ink is relatively dry upon the document and will not smear. This presents a problem of storing the documents during the drying period without leading to stoppages in the operation of the transport and in turn halting operation of the entire mailing system. Heretofore, it has been, the practice to extend the path of travel for documents to enable sufficient drying time prior to further manipulation of the document. Machines for drying articles, such as printed material, have often consisted of a long, substantially horizontal, conveyor belt on which articles to be dried are placed. A disadvantage of this type of machine is that, since they are longitudinally oriented, extending the path utilizes valuable space and consumes much time.

SUMMARY OF THE INVENTION

The present invention is directed to an apparatus for buffering transport of a document wherein the apparatus is adapted to handle a continuous flow of freshly inked sheets at a high rate. An apparatus having features of the present invention comprises an upper deck oriented at an acute angle with respect to a horizontal plane. The upper deck has an outer surface and a recessed substantially planar inner surface. The apparatus has a plurality of opposite, parallel, threaded screw conveyers orthogonal to the upper deck. The plurality of screw conveyers have a top shrouded by the inner surface. The apparatus will engage a document between the upper deck and the rotating, plurality of opposite, parallel threaded screw conveyers. Tapered guides are positioned adjacent the plurality of screw conveyers for maintaining the document in a substantially central position. The apparatus has a lower deck located beneath the plurality of screw conveyers with means for positioning the document between the plurality of screw conveyers and the lower deck, and means for ejecting the document horizontally from the apparatus along the lower deck.

BRIEF DESCRIPTION OF THE DRAWINGS

These and other objects and advantages of the present invention will become apparent from the following description of the accompanying drawings. It is to be understood that the drawings are to be used for the purpose of illustration only, and not as a definition of the invention.

In the drawings.

DESCRIPTION OF THE PREFERRED EMBODIMENT

Figure 1:
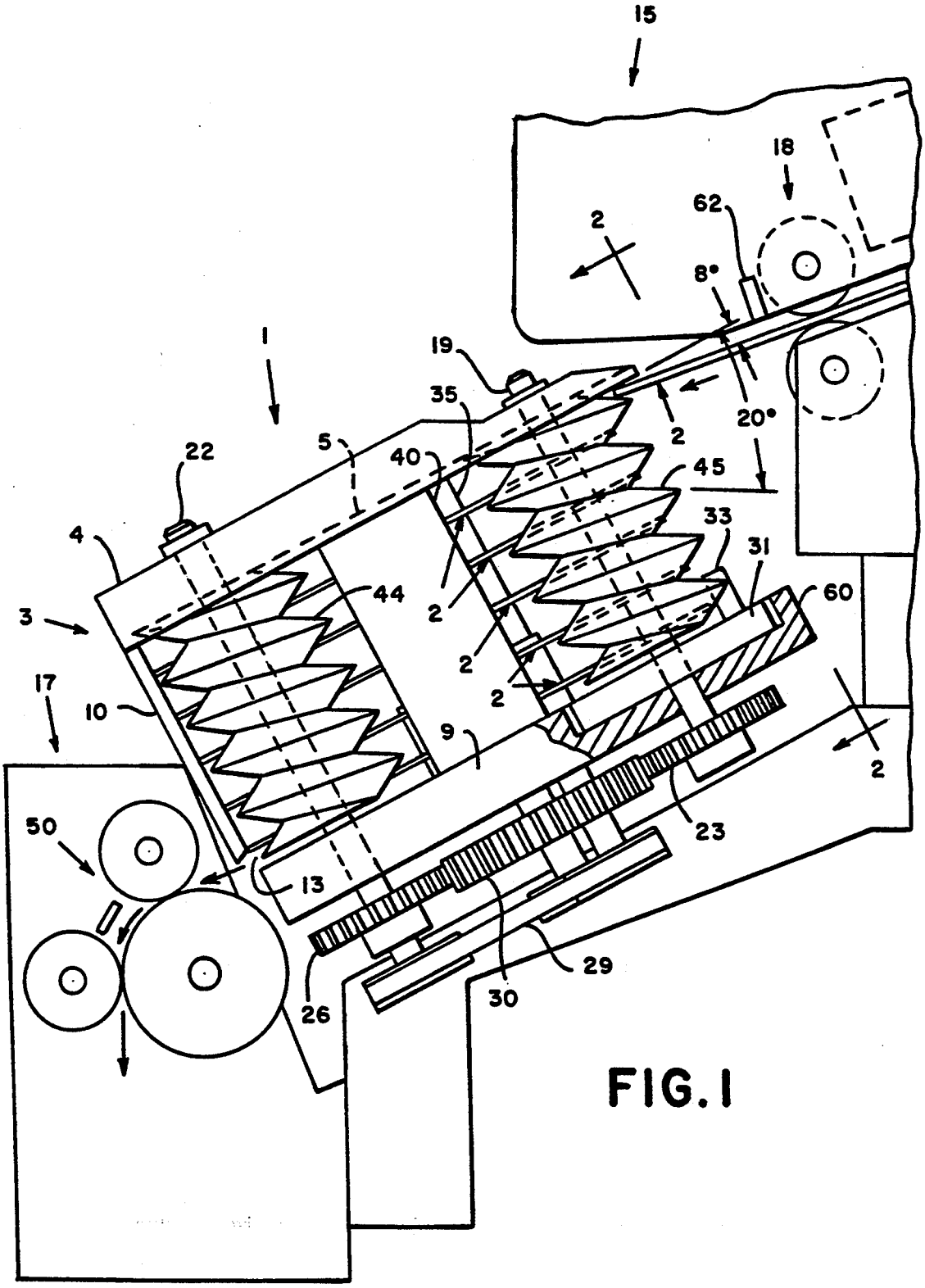
FIG. 1 is a side elevational view of the apparatus.

FIG. 1 shows an apparatus 1 suitable for buffering the transport of a series of documents 2, such as those coming from a printer 15. The printer 15 is preferably a conventional, stand-alone device. The printer 15 includes conventional printing structure, such as any conventional thermal, ink jet, or other commercially available printing apparatus, to which the documents 2 are fed. In addition, the printer 15 includes a conventional feeding structure. The feeding structure may be any conventional roller-type structure for engaging and feeding the documents 2, including a roller 18 for feeding documents 2 from the printer 15.

The apparatus 1 comprises an upper deck 3, oriented at an acute angle with respect to a horizontal plane, a lower deck 9, and a rear guide 10. The rear guide 10 is fixably mounted to the upper deck 3, extending generally perpendicular to and along one side of the upper deck 3. The apparatus 1 has a slit 13 between the rear guide 10 and the lower deck 9. The apparatus may eject documents 2 by passing the documents 2 through the slit 13, into a conventional document handler 17 such as an envelope flapper, document folder, or inserter. The document handler 17 includes a conventional feeding structure. The feeding structure may be any conventional roller-type structure for engaging and feeding the documents 2, including a roller 50 for feeding documents 2 into the document handler 17.

Figure 2:
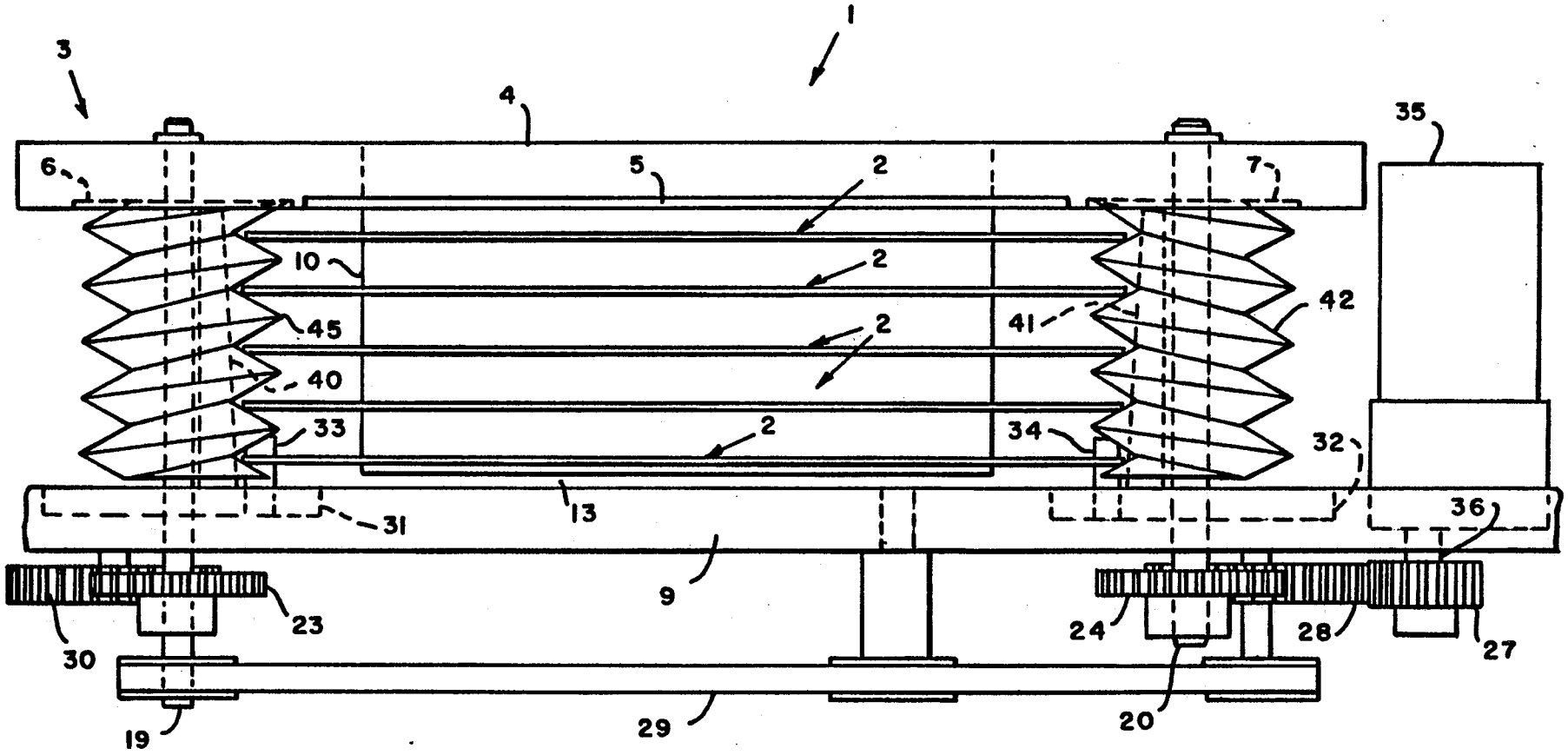
FIG. 2 is a vertical section on the line 2—2, FIG. 1.

Referring to FIG. 2, the upper deck 3 comprises an outer surface 4 and a recessed, substantially planar inner surface 5. The recessed inner surface 5 provides sufficient clearance for the documents 2 so that surface ink will not smear during transport. Tapered guides 40 and 41, opposite and parallel, extend vertically between the upper deck 3 and lower deck 9.

Figure 3:
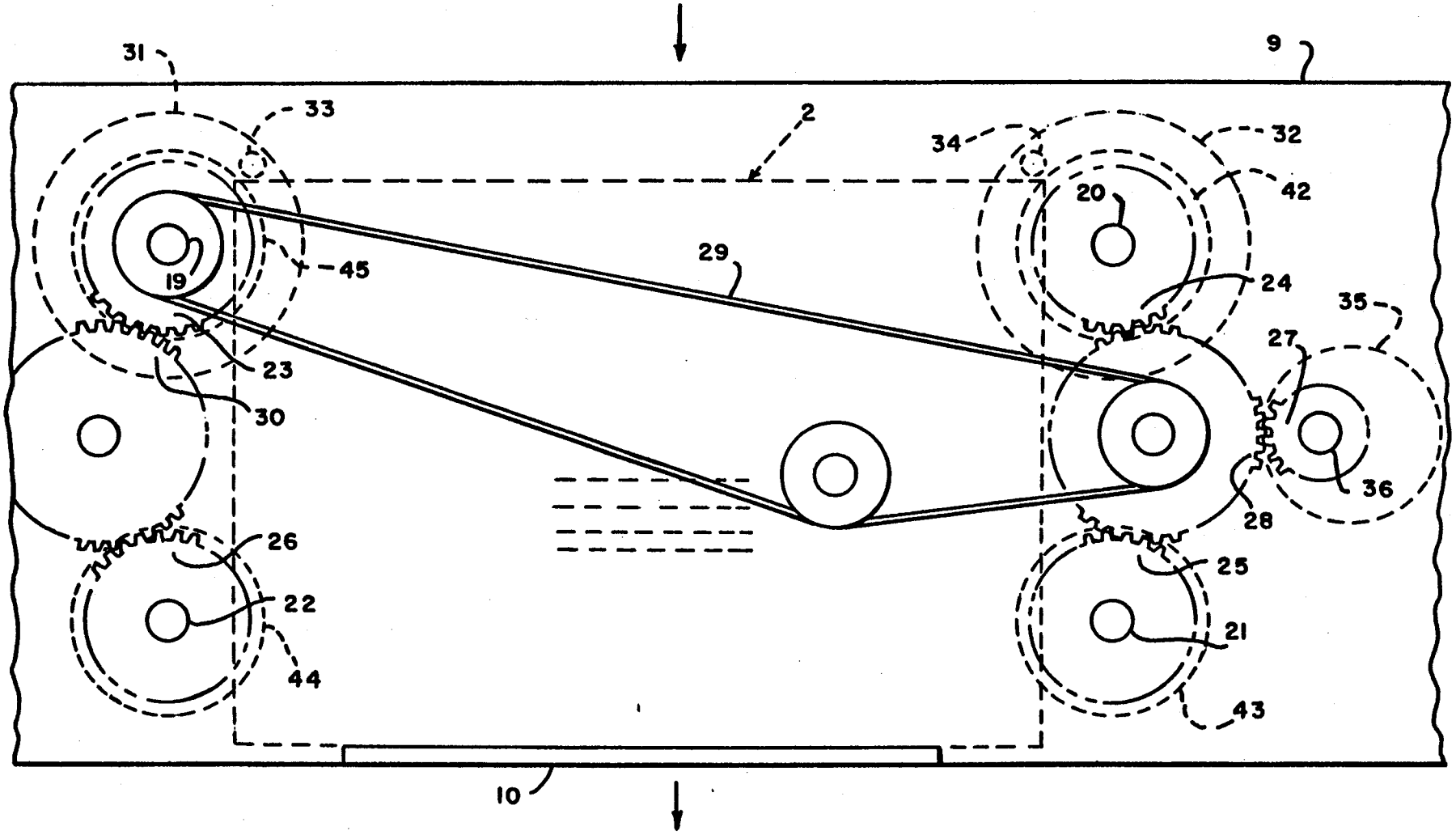
FIG. 3 is a bottom view of the apparatus.

Referring to FIGS. 2 and 3, a plurality of vertically disposed, opposite, parallel, threaded screw conveyers 42, 43, 44, and 45 are orthogonal to the upper deck 3. The screw conveyers 42, 43, 44, and 45 are mounted apart an appropriate distance to permit the edges or other suitable projection of documents 2 to engage in the threads of these conveyers 42, 43, 44, and 45. The screw conveyers are threaded to like pitch and oppositely, screw conveyers 42 and 43 being left hand and screw conveyers 44 and 45 being right hand. The thread depth of screw conveyers 42, 43, 44, and 45 is approximately $\frac{3}{8}''$ to allow for document 2 size variations of $\pm 1/16''$.

The inner surface 5 of the upper deck 3 shrouds the top 7 of each screw conveyer 42, 43, 44, and 45. The screw conveyers 42, 43, 44, and 45 are fixably mounted onto shafts 19, 20, 21, 22. The shafts 19, 20, 21, and 22 are rotatively mounted at one end to the upper deck 3. At the other end, the shafts 19, 20, 21, and 22 extend through the lower deck 9. Underneath the lower deck 9, gears 23, 24, 25, 26 are fixably mounted onto the shafts 19, 20, 21, and 22.

Referring to FIGS. 1 and 2, recessed disks 31 and 32 are fixably mounted onto shafts 19 and 20. The recessed disks 31 and 32 are set in a recess 60 and can be flush with the surface of the lower deck 9. Fixably mounted on each recessed disk 31 and 32 are vertically extending eject pins 33 and 34. The eject pins 33 and 34 assume a generally perpendicular orientation with respect to the lower deck 9.

Referring to FIG. 3, a motor 35 is mounted on the lower deck 9. The motor 35 has a shaft 36 on which is mounted a gear 27 which is in drive communication with an idler gear 28. The idler gear 28 is adapted to mesh with and drive gears 24 and 25 thereby imparting rotation to threaded screw conveyers 42 and 43. The idler gear 28 transmits motion to gear 23 by means of belt 29 thereby imparting rotation to threaded screw conveyer 45. Gear 23 transmits motion to gear 26 by means of idler gear 30, thereby imparting rotation to threaded screw conveyer 44.

In the embodiment of the invention as illustrated in FIGS. 1 to 3, a printer 15 prints information on documents 2 including a mailing address, bar code, or indicia. The printer transports inked documents 2 through feed roller 18 lead edge first. The upper deck 3 is oriented at an acute angle with respect to the printer 15 horizontal, preferably an approximate twenty degree angle. To overcome the natural curling action of documents 2 under the influence of the atmosphere, the documents 2 may be fed into the recessed inner surface 5 at an approximate eight degree angle. This feeding action bends the documents 2 thereby flattening the lead edge. The recessed inner surface 5 provides sufficient clearance so that the inked documents 2 will not smear during conveyance from the printer 15 to the apparatus 1. The documents 2 engage between the upper deck 3 and the threads of screw conveyers 42 and 45. The documents 2 must have sufficient stiffness to ride upon the threads of screw conveyers 42, 43, 44, and 45.

The top 7 of screw conveyers 42, 43, 44, and 45 lie above the inner surface 5 thereby ensuring the documents 2 fall within the pitch of screw conveyers 42, 43, 44, and 45. Each pitch of screw conveyers 42, 43, 44, and 45 creates a drying station for inked documents 2. In the preferred embodiment, there are five pitches per screw conveyer 42, 43, 44, and 45 having an approximate allotted drying time of four seconds per document. The drying time may be increased or decreased by changing the software parameters controlling the number of screw conveyer 42, 43, 44, and 45 revolutions per second.

The roller 18 feeds the documents 2 until a sensor detects the trail edge exiting the printer 15. At that time, the lead edge abuts rear guide 10 and rests on screw conveyers 43 and 44; the trail edge rests on screw conveyers 42 and 45. After the sensor detects the trail edge exiting the printer 15, the motor 35 rotates thereby imparting motion to the screw conveyers 42, 43, 44, and 45. As the screw conveyers 42, 43, 44, and 45 rotate, tapered guides 40 and 41 center the documents 2 traveling downward along the threads to the next pitch of screw conveyers 42, 43, 44, and 45.

At the lowest drying station in the apparatus 1, eject pins 33 and 34 engage the trail edge of the document 2 as the document 2 leaves screw conveyers 42 and 45 thereby advancing the document 2 forward through slit 13 a predetermined distance wherein the lead edge of the document 2 is buckle registered into the nip of roller 50. The trail edge of documents 2 may not rise above eject pins 33 and 34 thereby impairing ejection of the documents 2 from the apparatus 1. Hence, the eject pins 33 and 34 may include means for keeping the documents 2 flush with the lower deck 9.

The afore description is of the preferred embodiment of the present invention and should not be viewed as limiting to the invention. It will be understood that numerous details may be altered or omitted without departing from the spirit of the invention. The scope of the invention is defined by the following claims.

What is claimed is:

1. An apparatus for buffering transport of a document, the apparatus comprising:

a) an upper deck having an outer surface and a recessed substantially planar inner surface;

b) a plurality of opposite, parallel, threaded screw conveyers orthogonal to the upper deck, the plurality of screw conveyers having a top shrouded by the recessed substantially planar inner surface;

c) means for engaging the document between the upper deck and the plurality of screw conveyers;

d) means for rotating the plurality of screw conveyers;

e) tapered guides positioned adjacent the plurality of screw conveyers for maintaining the document in a substantially central position;

f) a lower deck located beneath the plurality of screw conveyers; and g) means for ejecting the document horizontally from the apparatus along the lower deck.

2. An apparatus as set forth in claim 1, further comprising a rear guide for registering of the document, the rear guide fixably mounted to the apparatus and extending generally perpendicular to and along one side of the upper deck.

3. An apparatus as set forth in claim 2, the rear guide being provided with a slit for the document to exit along the lower deck.

4. An apparatus as set forth in claim 1 wherein the means for ejecting the document includes an eject pin mounted onto a disk.

5. An apparatus for buffering transport of a document as set forth in claim 4, further comprising means for actuating the eject pin in synchronism with the rotating plurality of screw conveyers.

6. An apparatus for buffering transport of a document as set forth in claim 1, further comprising sensor means for actuating the rotation of the plurality of screw conveyers.

7. An apparatus for buffering transport of a document as set forth in claim 1 wherein the document enters the apparatus at an angle of at least eight degrees with respect to the upper deck.

8. A mailing system comprising:

a) a printer for printing on a document;

b) means for driving the document into a buffer, the buffer comprising:

i) an upper deck oriented at an acute angle with respect to a horizontal plane of the printer, the upper deck having an outer surface and a recessed substantially planar inner surface;

ii) a plurality of opposite, parallel threaded screw conveyers orthogonal to the upper deck, the plurality of screw conveyers having a top shrouded by the recessed substantially planar inner surface;

iii) means for rotating the plurality of opposite, parallel threaded screw conveyers;

iv) tapered guides positioned adjacent the plurality of screw conveyers for maintaining the document in a substantially central position;

v) a lower deck located beneath the plurality of screw conveyers; and vi) means for ejecting the document horizontally from the apparatus along the lower deck;

c) means for transferring the document from the buffer to a downstream document handler.

9. A mailing system as set forth in claim 8 wherein the upper deck is oriented at an angle of at least twenty degrees with respect to the horizontal plane of the printer.

10. A method of buffering transport of a document for a selected time period, the method comprises:

a) engaging a document between an upper deck and an uppermost thread of a plurality of screw conveyers;

b) rotating the plurality of opposite, parallel threaded screw conveyers so that a document remains in the buffer for the time period, the time period varying proportionately with respect to a number of revolutions per second, and the time period being selected to be approximately equal to a drying time for ink printed on the document;

c) maintaining the document in a substantially central position between the plurality of screw conveyers;

d) positioning the document between the plurality of opposite, threaded screw conveyers and a lower deck; and e) ejecting file document horizontally from the apparatus along the lower deck.

* * * * *